US008546279B2

(12) United States Patent
Higashiguchi et al.

(10) Patent No.: US 8,546,279 B2
(45) Date of Patent: Oct. 1, 2013

(54) CLOTH MATERIAL FOR MARKING

(75) Inventors: Shigeji Higashiguchi, Tokyo (JP); Shinichi Nagai, Tokyo (JP)

(73) Assignee: Houlaisha Co., Ltd., Tokyo (JP)

( * ) Notice: Subject to any disclaimer, the term of this patent is extended or adjusted under 35 U.S.C. 154(b) by 1247 days.

(21) Appl. No.: 11/667,967

(22) PCT Filed: Apr. 18, 2006

(86) PCT No.: PCT/JP2006/308489
§ 371 (c)(1),
(2), (4) Date: Jul. 3, 2007

(87) PCT Pub. No.: WO2006/115235
PCT Pub. Date: Nov. 2, 2006

(65) Prior Publication Data

US 2007/0289712 A1 Dec. 20, 2007

(30) Foreign Application Priority Data

Apr. 22, 2005 (JP) ..... 2005-124850

(51) Int. Cl.
*B32B 27/04* (2006.01)

(52) U.S. Cl.
USPC ..... 442/149; 442/59

(58) Field of Classification Search
USPC ..... 442/59, 149
See application file for complete search history.

(56) References Cited

U.S. PATENT DOCUMENTS 3,860,388 A * 1/1975 Haigh ..... 8/471
3,952,131 A * 4/1976 Sideman ..... 8/468
4,153,412 A * 5/1979 Bailey ..... 8/471
4,419,102 A * 12/1983 Gorondy ..... 8/471
2004/0053001 A1* 3/2004 Abrams ..... 428/90

FOREIGN PATENT DOCUMENTS

JP 2000-43397 A 2/2000
JP A 2001-324928 11/2001
JP 2002-371416 A 12/2002
JP A 2004-100050 4/2004

OTHER PUBLICATIONS

Translation of JP 2004-100050 (11 pages total).*

* cited by examiner

*Primary Examiner* — Peter Y Choi
(74) *Attorney, Agent, or Firm* — Sheldon J. Moss; Chad M. Herring

(57) ABSTRACT

A cloth material for marking including: a label cloth made of a white cloth formed of a fiber containing a component having affinity for a sublimation dye; an intermediate layer disposed on a rear surface of the label cloth, the intermediate layer including a synthetic resin which has affinity for the component of the label cloth and which has a melting point higher than a sublimation temperature of the sublimation dye; a transfer adhesive layer including a hot-melt thermoplastic synthetic resin and disposed on a surface of the intermediate layer; and a sheet of release paper disposed on a surface of the transfer adhesive layer. The intermediate layer is formed and closely fixed on the rear surface of the label cloth by laminating or coating. The transfer adhesive layer is also formed by laminating or coating. Desired colors, patterns and/or figures are transferable from transfer paper printed with a sublimation dye onto a surface of the cloth material for marking that has a transfer adhesive layer on its rear surface.

6 Claims, 4 Drawing Sheets

CLOTH MATERIAL FOR MARKING

CROSS-REFERENCE TO RELATED APPLICATIONS

This application is a national phase application under 35 U.S.C. §371 of International Application No. PCT/JP2006/308489, which claims priority under 35 U.S.C. §119 from Japanese Patent Application No. 2005-124850, the disclosures of which are incorporated by reference herein.

TECHNICAL FIELD

The present invention relates to a cloth material for marking or label making where the mark or label can be transfer-printed. The present invention employs a sheet of transfer paper, on which various colors, patterns, designs and/or the like are printed using a sublimation dye, and the color, patterns, designs and/or the like of the transfer paper are transferred to a surface of the cloth material, the rear surface of which has an adhesive layer being already formed.

BACKGROUND ART

Hereinbelow, a conventional process for producing a label (called also a "mark") and the structure of the label itself produced by the process will be described with reference to FIG. 3.

First, a label cloth 1 is prepared from a cloth such as textile fabrics, knitted fabrics, non-woven fabrics and the like, to which fabrics a desired color, a desired pattern, a desired design and/or the like are printed by silk-screen printing process or the like.

Next, a rear surface of the label cloth 1 is coated with a pasty hot-melt type thermoplastic synthetic resin to a predetermined thickness, and then dried to form a so-called transfer adhesive layer 2. Alternatively, the transfer-printing adhesive layer 2 may be formed by a process such as laminating a hot-melt thermoplastic synthetic resin film having a predetermined thickness to a rear surface of the label cloth 1. The transfer adhesive layer 2 contains a hot-melt thermoplastic synthetic resin as one of its components. The adhesive layer 2 thus formed is then backed with a sheet of release paper 3 to prepare a cloth material for label making, that is, a label cloth 4.

In preparing a mark (or a label) from the label cloth 4, the label cloth 4 is cut into a desired shape to obtain mark (or label) 5 having desired colors, patterns and/or designs.

Accordingly, the conventional label (or mark) has a structure as shown in FIG. 4, in which transfer adhesive layer 2 is formed on label cloth 1, lined with release paper 3.

Next, a procedure by which label 5 is bonded to clothes such as a uniform or like items will be described.

First, the release paper 3, which has been placed on the transfer adhesive layer 2 on the rear surface of the label 5, is removed.

The label 5 is overlaid on cloth surface such as a uniform (not shown) with the transfer adhesive layer 2 being touched with the cloth surface. Then, the label 5 and the cloth thus coupled one another are subjected to a hot pressing process in which they are compressed together under a pressure of approximately 200 g/cm$^2$ for about 30 seconds at a temperature of approximately 150° C. using a hot press or the like, so that the transfer adhesive layer 2 of the label 5 is melted between the cloth of the uniform or the like and the cloth of the label 5, whereby the cloth of the label 5, that is, the label cloth 6 and the corresponding cloth of the uniform or the like are bonded to each other through the application of heat without damaging the cloths.

Incidentally, the development of transfer paper has been advanced in that various colors, patterns, designs and the like are printed on a sheet of transfer paper with a so-called sublimation dye. Along with the conventional silk screen process printing techniques, techniques for producing a cloth material for a label or a mark (hereinafter referred to as "a label cloth material") have come to be widely used in the art of label making where transfer paper such as having a structure as shown in FIG. 5 is used.

Hereinbelow, the techniques for producing a label cloth material having a structure shown in FIG. 5 using the transfer paper currently employed in the art of label making will be described.

As label cloth 6 (a component of the label cloth material 11), a cloth having affinity for a sublimation dye so that the dye is sublimated and transferred onto the cloth may be selected. Typical examples of such a cloth include a white cloth (a cloth having a white base) of textile fabrics, knitted fabrics, non-woven fabrics and the like made of, for example, polyester fibers. A composite cloth 8 is prepared to produce a label cloth material 11 shown in FIG. 5, where cloth 8 is prepared by: applying a temporary adhesive 7' on a non-woven fabric cloth 7; overlaying label cloth 6 on the non-woven fabric cloth 7 on the side where the temporary adhesive 7' is applied; subjecting the cloth to heating/pressing operations by a heating/pressing machine, whereby the composite cloth 8 backed with the non-woven fabric 7 is prepared.

Then, the printed surface of the transfer paper is pressed against a surface of the white label cloth 6 of the composite cloth 8 and heating/pressing operation is performed by the heating/pressing machines and the like. The colors, patterns, designs and the like that have been printed on the transfer paper with the sublimation dye are transfer-printed onto the surface of the white label cloth 6 by sublimating the sublimation dye.

The above-mentioned transfer printing is carried out on the following conditions: heating temperature of approximately 200° C.; pressure of approximately 300 g/cm$^2$; and a period of the heating/pressing processes of approximately 60 seconds.

On a surface of the non-woven fabric cloth 7 of the composite cloth 8, a transfer adhesive layer is formed with a hot-melt type thermoplastic synthetic resin according to a conventional method. The transfer adhesive layer has the function of transferring/applying the mark to an object such as a user's uniform and like items. Then, the release paper 10 is applied to a surface of the transfer adhesive layer 9 to obtain the label cloth material 11 having the structure shown in FIG. 5.

Similar to the transfer adhesive layer 2 for a conventional type of a label cloth material shown on FIG. 3, the transfer adhesive layer 9 is usually set to have a melting point of about 150° C., and is supposed to be subjected to heating/pressing processes for 30 seconds under about 200 g/cm$^2$ of pressure.

In order to obtain a label from the label cloth material 11 that has been produced by the above-described means, the cloth material 11 for marking is cut into a desired shape to obtain the label 12 as shown in FIG. 6.

Therefore, it should be noted that it is impossible produce a cloth material for marking 11 in the following manner: preparing a label cloth 6 selected from white cloths such as textile white fabrics, knitted white fabrics, non-woven white fabrics and like made of polyester fibers; preparing composite cloth 8 by backing the label cloth 6 with a non-woven fabric 7 with a temporary adhesive agent 7'; completing the preparation of the cloth material for marking by forming a transfer adhesive layer 9 on a rear surface of the composite cloth 8; and, after that, transferring colors, patterns, designs and the like printed on the transfer paper with the sublimation dye onto the cloth of label cloth 6 of the composite cloth 8 that is a component of the cloth material for marking so as to produce a cloth material for marking 11 with colors, etc. transferred thereon.

The following reasons can be raised for why it is impossible to produce the cloth material for marking 11 in the above procedure. First, the transferring temperature at which colors, patterns and designs are transferred onto label cloth 6 of a cloth material for marking by sublimating the sublimation dye printed on the transfer paper is different from the melting point (temperature) of the transfer adhesive layer 9 formed on the cloth material for marking. Second, due to differences in pressure and time period of the transfer-printing process, the transfer adhesive layer 9 is melted first so that the molten resin of the transfer adhesive layer 9 seeps and soaks through the non-woven fabric 7 of composite cloth 8, whereby the molten resin appears and covers the front surface of the label cloth 6. This results in a failure in the transfer-printing process since the molten resin forms a thin film on the surface of the label cloth 6.

Furthermore, other disadvantages may arise when the label is bonded to the user's uniform and like items under conditions in which: a heating/pressing machine of the conventional type is used in applying the label to the uniform and like items; the label cloth 6 is prepared from white textile fabrics, knitted fabrics, non-woven fabrics and like white fabrics formed from polyester fibers currently widely used in the art of the label; this label cloth 6 is backed with the non-woven fabric 7 to prepare the composite cloth 8, wherein a temporary adhesive 7' has been applied to the non-woven fabric 7; the label cloth 6 of the composite cloth 8 is transfer-printed by using the transfer paper so that the label cloth 6 bears the colors, patterns and the designs thus transfer-printed; the transfer adhesive layer 9 is formed in the non-woven fabric 7 of the composite cloth 8, so that the label 12 shown in FIG. 6 is produced, wherein the cloth material 11 for marking is subjected to templating process to assume the shape of the label 12. The specific disadvantages are set forth below.

Although the non-woven fabric 7 of the composite cloth 8 forming a component of the label is firmly bonded to the user's uniform and like items, the label 12 bonded to the uniform and the like is poor in durability in washing since the non-woven fabric 7 and the label cloth 6 is temporarily bonded to each other through the temporary adhesive 7'. This results in a peeling-off accident of the label 12 during washing the clothes. The label is also poor in abrasion resistance.

When the transfer adhesive layer 9 is formed after removing the non-woven fabric 7 after completion of the transfer printing process of the colors, patterns and designs of the transfer paper transferred onto the label cloth 6 of the composite cloth 8, the label cloth 6 having been transfer-printed to bear the colors, patterns and the designs using the transfer paper described above has the disadvantage that the label cloth 6 is deformed during the removing (peeling-off) operation.

Further, another disadvantage appears when the temporary adhesive layer 7' is increased in thickness in order to solve the above-mentioned disadvantages and in order to more firmly bond the non-woven fabric 7 to the label 6 so that the composite cloth 8 is produced. The temporary adhesive layer 7' thus increased in thickness is melted so that the molten resin of the temporary adhesive layer 7' seeps and soaks through the non-woven fabric 7 to appear in the backside of the fabric 7, whereby such molten resin forms a film over the surface of the label cloth 6. As a result, it is impossible to produce a good product or label cloth material for marking when the cloth material for marking formed from the composite cloth 8 having a temporary adhesive layer with increased thickness; and, also impossible to produce a good label when the cloth material for marking formed from the composite cloth 8 described above.

This is a novel invention provided to overcome the disadvantages of the conventional type of label cloth material for marking in which the transfer adhesive layer is formed on the composite cloth. There are no references that help to develop the present invention.

The invention has been made under these circumstances, and provides a cloth material for marking capable of forming desired colors, patterns and designs in a cloth, which is formed into a label cloth by using a sheet of transfer paper having been printed with a sublimation dye, so that the disadvantages of the conventional type of a cloth material for marking and of a label both currently produced in the art of the label and the cloth material for marking.

DISCLOSURE OF THE INVENTION

In the present invention, a label cloth forming a label cloth material uses a cloth made of fibers containing a component having affinity for a sublimation dye, the typical example of which is a white cloth (a cloth with a white ground) formed from polyester fibers.

A layer of a synthetic resin having affinity for a component of a cloth forming a label cloth described above is formed as an intermediate (interposed) layer. The synthetic resin may have a melting (fusing) point set higher than a sublimation temperature of the sublimation dye. The intermediate layer may be formed on a backside of the marking cloth by laminating or coating so as not to be peeled off from the cloth.

A transfer adhesive layer made of a hot-melt type thermoplastic synthetic resin may be formed on/over the intermediate layer by a conventional means for producing a conventional cloth for marking by laminating or coating.

A heat-resistant film may further be formed on the surface of the intermediate layer. A transfer adhesive layer made of a hot-melt type thermoplastic synthetic resin may be disposed on a surface of this heat-resistant film by laminating or coating.

A sheet of release paper is placed on a surface of the transfer adhesive layer, so that the cloth material for marking (for label making) is produced through the processes mentioned above.

According to the above structure, it is possible to prevent the transfer adhesive layer from seeping or soaking through the label cloth when the layer is heated in a heating/pressing machine for transfer-printing the sublimation dye to the label cloth. This is due to the provision of the intermediate layer made of a synthetic resin having a melting point set higher than the sublimation temperature of the sublimation dye.

Further, a heat-resistant film may be provided between the intermediate layer and the transfer adhesive layer so that it becomes possible to surely avoid the influence from heating during transfer-printing of the sublimation dye onto the label cloth.

The present invention provides: preparing a label cloth made of a white cloth including fibers containing a component having affinity for a sublimation dye; forming an intermediate layer with a synthetic resin having a melting point higher than a sublimation transfer temperature with the sublimation dye; forming a transfer adhesive layer on the intermediate layer including a hot-melt type thermoplastic synthetic resin; and backing with a sheet of release paper to prepare a cloth material for marking. Therefore, it would be possible for a label producer to produce a label cloth and produce a mark (or label) having desired colors, patterns, and/or designs by transfer-printing a sublimation dye from transfer paper with a conventional type of heating/pressing machine, if the label producer obtained the cloth material for marking of the present invention.

BEST MODE FOR CARRYING OUT THE INVENTION

A white cloth made of fibers comprising a component having affinity for a sublimation dye is provided as a label cloth (mark cloth). An intermediate layer made of a synthetic resin, which has affinity for a component constituting the label cloth and has a melting point higher than the sublimation temperature of the sublimation dye, is formed on the backside of the label cloth. A transfer adhesive layer made of a hot-melt type thermoplastic synthetic resin is formed on the surface of the intermediate layer. A sheet of release paper is applied to the surface of the transfer adhesive layer, so that the cloth material for marking (label making) is prepared.

Embodiment 1

Figure 1:
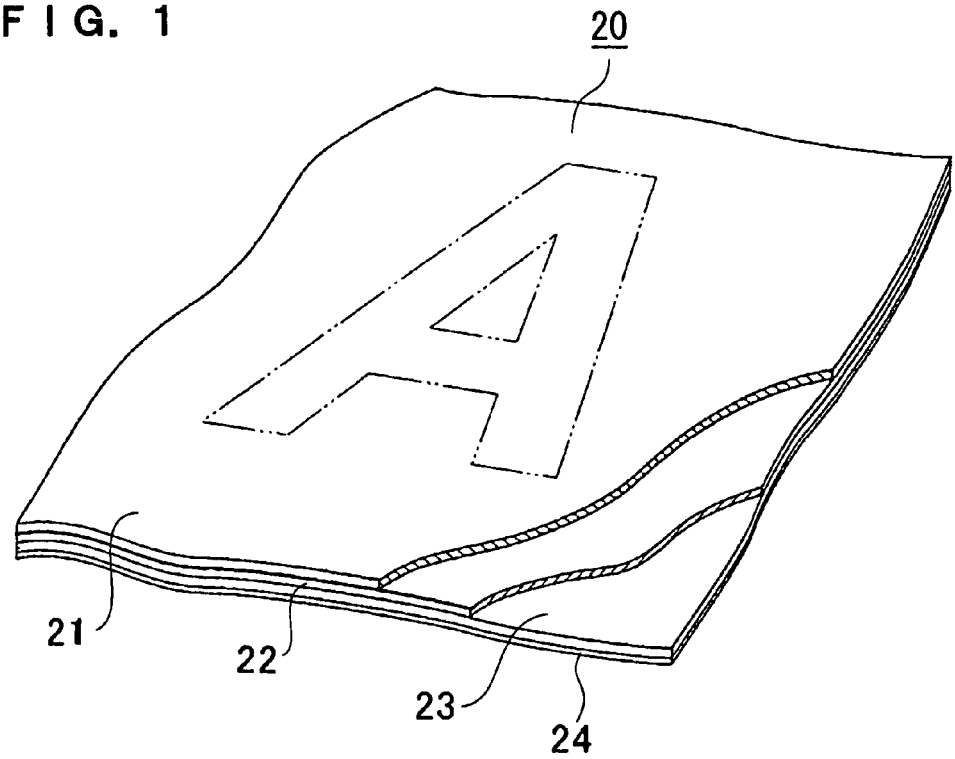
FIG. 1 is a partially broken perspective view of a cloth material for label making of the present invention.

A cloth material 20 for marking (label making) of the present invention has a structure as shown in FIG. 1. A cloth that forms a label cloth 21 constituting the cloth material for label making 20 of the present invention is made of fibers including a component having affinity for a sublimation dye. Typical examples of the cloth used here include a white cloth such as textile white fabrics, knitted white fabrics, non-woven white fabrics, etc. like polyester fibers.

The label cloth 21 is used here for transfer-printing various colors, patterns, designs and/or the like onto the cloth by using a sheet of transfer paper printed with a sublimation dye so that the cloth has such transfer-printed colors, patterns, designs and/or the like as a result of the transfer printing of the cloth and sublimation of the sublimation dye used in the printing. The sublimation dye cannot be transferred to the cloth made of other materials such as nylon-base synthetic resins with sharp images of colors, patterns, designs and/or the like.

Further, the label cloth 21 should be made of a fabric comprising a component capable of enduring the sublimation temperature of the sublimation dye mentioned above, since the label cloth 21 is transfer-printed by using the transfer paper in a manner such that the sublimation dye having been printed on the transfer paper is subjected to heating/pressing processes to sublimate so that the colors, patterns, designs and/or the like of the transfer paper are transferred to the cloth.

A heat-resistant intermediate layer 22, which is made of a thermoplastic synthetic resin having affinity with the label cloth 21, is formed on a rear surface of the label cloth 21.

This heat-resistant intermediate layer 22 may be formed by coating the synthetic resin with a solvent, or laminating a film made of the synthetic resin, so that the intermediate layer 22 has a thickness of approximately within a range of 20 μm to 70 μm.

The intermediate layer 22 should not be deformed or melted during the heating/pressing processes in which colors, patterns, designs and/or the like are transferred from a transfer paper to the label cloth 21. In other words, the intermediate layer 22 should be made of a thermoplastic resin having a similar heat resistance property as the label cloth 21.

Formed in a rear surface of the intermediate layer 22 is a transfer adhesive layer 23 made of a hot-melt type thermoplastic synthetic resin, which has affinity for the synthetic resin of the intermediate layer 22. That transfer adhesive layer 23 may be formed by coating a hot-melt type thermoplastic synthetic resin with a solvent, or laminating a film of the hot-melt type thermoplastic synthetic resin.

Release paper 24 is applied to the rear surface of the transfer adhesive layer 23 according to a usual method.

The cloth material for label making of the present invention having a structure shown in FIG. 1 is prepared through these processes described above.

Since the cloth material for label making 20 of the present invention is prepared through the above procedures, the cloth material 20 has a structure as shown in FIG. 1 including: label cloth 21 of a white cloth prepared from textile fabrics, knitted fabrics, non-woven fabrics and like fabrics, the intermediate layer 22 disposed on the rear surface of the label cloth 21, the transfer adhesive layer 23 disposed on the rear surface of the intermediate layer, and release paper 24 disposed on the rear surface of the transfer adhesive layer.

In order to prepare the cloth material for label making 20 provided with the label cloth 21 bearing the desired colors, patterns and/or designs, the white cloth of the label cloth 21 of the cloth material for label making 10 is overlaid with a printed surface of a transfer paper, wherein the transfer paper has been printed with the sublimation dye to bear the desired colors, patterns and/or designs on its printed surface and subjected to heating/pressing processes in which the transfer paper and the white cloth overlaid therewith are heated for a time period of about 60 seconds at a temperature of approximately 200° C. under about 300 g/cm$^2$ of pressure.

Through this operation, the sublimation dye used in printing to express the desired colors, patterns, and/or designs is transferred from the transfer paper to the white label cloth 21, so that the desired colors, patterns, and/or designs are formed with the sublimation dye on a surface of the white label cloth.

During this operation, the transfer adhesive layer 23 made of the hot-melt type thermoplastic synthetic resin is melted between the intermediate layer 22 and the release paper 24. Because of the intermediate layer 22 disposed on the white label cloth 21 as a component of the cloth material for label making 20 of the present invention, there is no concern that the synthetic resin which has been melted and forms a component of the transfer adhesive layer 23 seeps or soaks into the label cloth 21. Further, there is neither a concern that such molten resin seeps or soaks through the release paper.

Consequently, in contrast with the conventional process, in the present invention defective products would not be produced.

In other words, if only a label maker, who produces a label or mark in the art obtained the cloth material for label making 20, the label maker would be able to produce a label cloth for marking of the present invention, where the label cloth has been transfer-printed using a conventional type of heating/pressing machine and the transfer paper having been printed with the sublimation dye to bear the desired colors, patterns, and/or designs.

Figure 2:
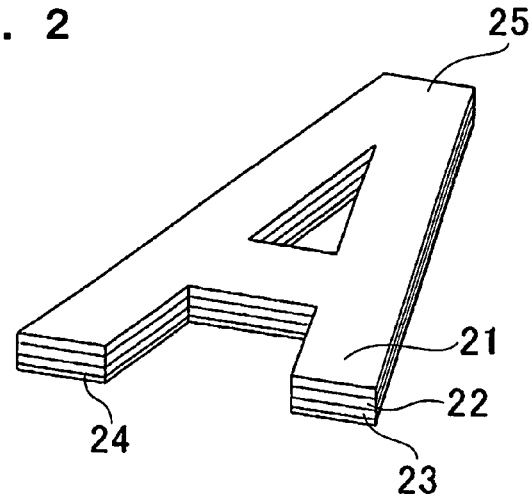
FIG. 2 is a perspective view of a label produced with a cloth material for label making according to the present invention.
Figure 3:
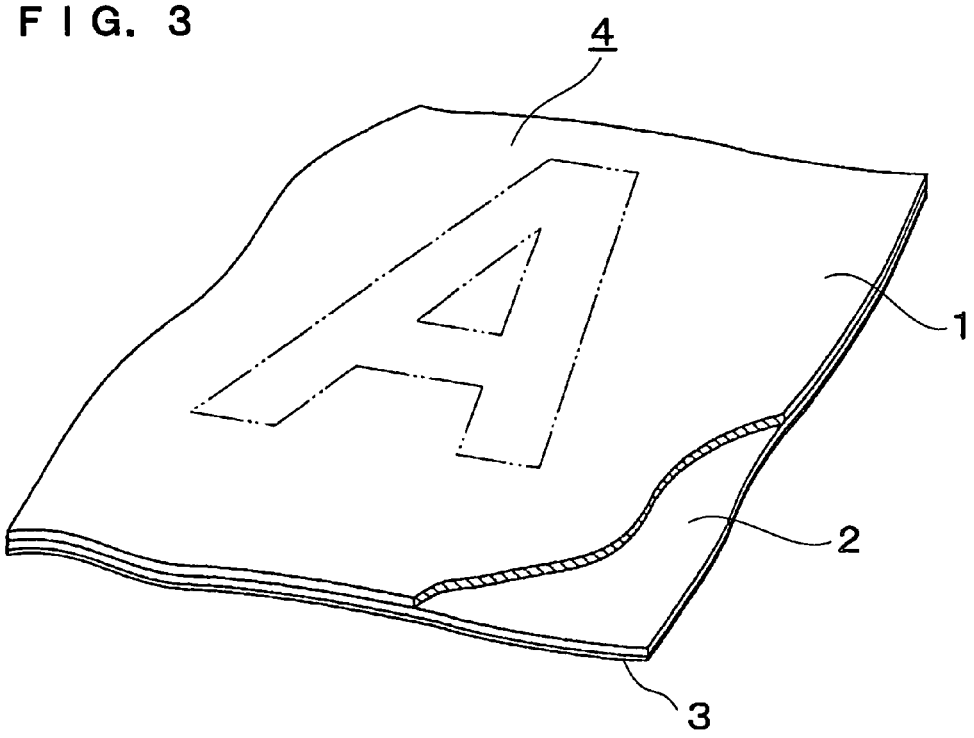
FIG. 3 is a partially broken perspective view of a conventional cloth material for label making.
Figure 4:
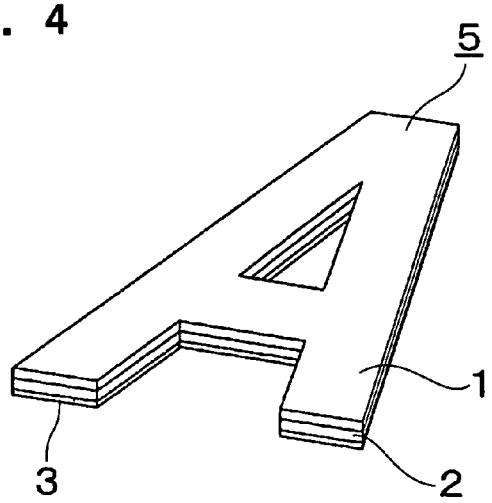
FIG. 4 is a perspective view of a label produced with a conventional cloth material for label making.
Figure 5:
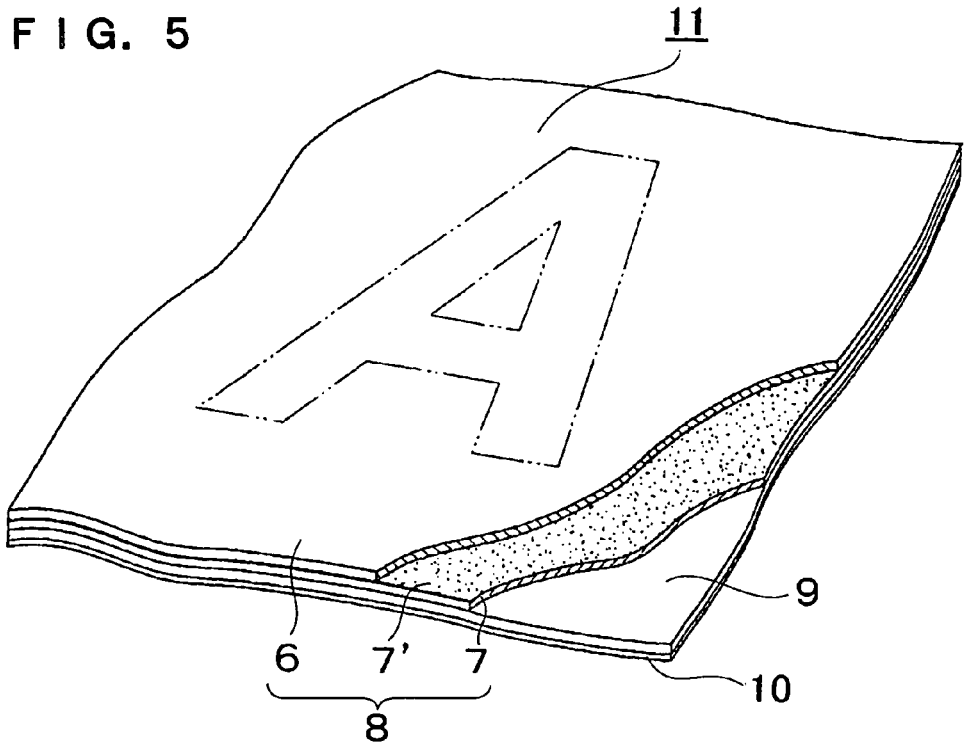
FIG. 5 is a partially broken perspective view of a conventional cloth material for label making produced with a composite cloth.
Figure 6:
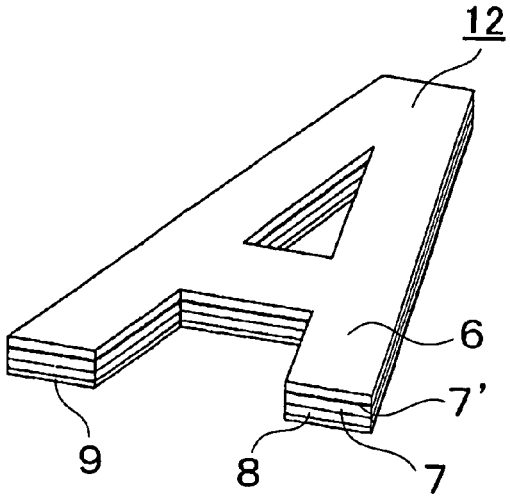
FIG. 6 is a perspective view of a label produced with a conventional composite cloth material for label making.

In processes for obtaining a label or mark from the cloth material for label making of the present invention, it is natural that the label maker uses a conventional method to cut the cloth material into a desired shape so as to obtain label 25 shown in FIG. 2.

Further, it is also natural to apply the label 23 to a uniform or like items according to the conventional method in the art.

Embodiment 2

Figure 7:
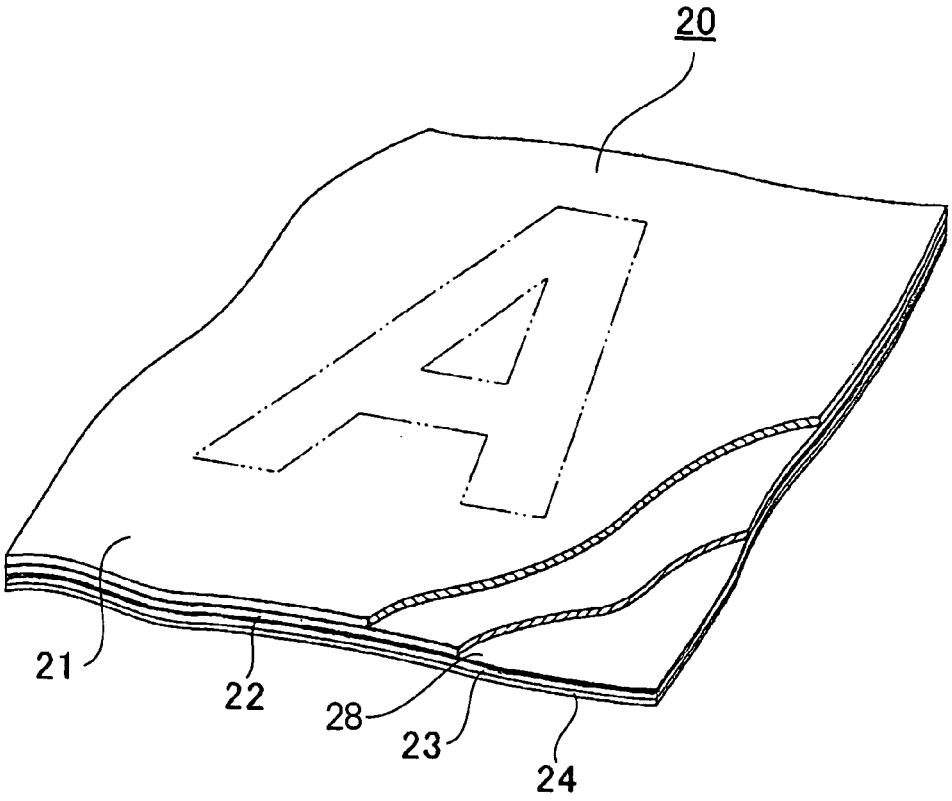
FIG. 7 is a partially broken perspective view of a cloth material for label making produced according to another embodiment of the present invention.

Another embodiment of the cloth material for label making of the present invention is shown in FIG. 7.

In the drawing, the same parts as in FIG. 1 are provided with the same reference numerals.

In this embodiment, a heat-resistant film 28 is formed in a lower surface of the intermediate layer 22 (i.e., the surface opposite from the side where the label cloth 21 is disposed). Formed on the surface of this film 28 is the transfer adhesive layer 23, which is made of the hot-melt type thermoplastic synthetic resin by laminating or coating. As the heat-resistant film 28, a synthetic resin sheet that has affinity for the intermediate layer 22 and that has a thickness of, for example, approximately 50 μm may be used. It is necessary that the material of the film 28 be a heat-resistant film sheet, so that there is no concern that the material is deformed or melted in the heating/pressing processes when the colors, patterns and/or designs of the transfer paper are transferred to the label cloth 21 through transfer printing process (i.e., sublimation of the dyes). Furthermore, a synthetic resin having rubber elasticity may be used as a material for the intermediate layer 22, the heat-resistant film 28 or the transfer adhesive layer 23, for example, so that the label (mark) 25 may be improved in flexibility.

In the present embodiment, the sublimation dye may be transfer-printed to the label cloth 21 by heating/pressing under the conditions of heating temperature of approximately 200° C., pressure of approximately 300 g/cm$^2$, and a period of time in heating/pressing processes of approximately 60 seconds. Under these conditions, even if a lower layer (transfer adhesive layer 23) is melted by heat supplied from the upper layer, the molten synthetic resin can be blocked and the molten synthetic resin does not soak or leak onto the side of label cloth 21 due to the existence of the intermediate layer 22 and the heat-resistant film 28.

Furthermore, even when the intermediate layer 22 has a thickness as thin as approximately 10 μm, the existence of the heat-resistant film 28 makes it possible to surely block the molten resin of the lower layer (transfer adhesive layer 23) even when the transfer adhesive layer 23 is melted during transfer-printing the sublimation dye to the label cloth 21 by heating/pressing, so as to prevent adverse effects from the heating/pressing.

The remaining effects are the same as in the case of the cloth material for label making 20 shown in FIG. 1.

The invention claimed is:

1. A cloth material for marking comprising:

a label cloth made of a white cloth that has been printed using a sublimation dye printing process;

an intermediate layer disposed on a rear surface of the label cloth, the intermediate layer comprising a synthetic resin which has a melting point higher than a sublimation temperature of the sublimation dye used in the sublimation dye printing process; and a transfer adhesive layer comprising a hot-melt thermoplastic synthetic resin and disposed on a surface of the intermediate layer.

2. A cloth material for marking comprising:

a label cloth made of a white cloth that has been printed using a sublimation dye printing process;

an intermediate layer disposed on a rear surface of the label cloth, the intermediate layer comprising a synthetic resin which has a melting point higher than a sublimation temperature of the sublimation dye used in the sublimation dye printing process;

a synthetic resin sheet disposed on a surface of the intermediate layer; and a transfer adhesive layer comprising a hot-melt thermoplastic synthetic resin and disposed on a surface of the synthetic resin sheet disposed on a surface of the intermediate layer.

3. The cloth material of claim 1, further comprising a sheet of release paper disposed on a surface of the transfer adhesive layer.

4. The cloth material of claim 2, further comprising a sheet of release paper disposed on a surface of the transfer adhesive layer.

5. The cloth material of claim 1, wherein the label cloth made of a white cloth comprises textile fabrics, knitted fabrics, or non-woven fabrics.

6. The cloth material of claim 2, wherein the label cloth made of a white cloth comprises textile fabrics, knitted fabrics, or non-woven fabrics.

* * * * *